US006323835B1

(12) United States Patent
Negishi et al.

(10) Patent No.: US 6,323,835 B1
(45) **Date of Patent: *Nov. 27, 2001**

(54) DEVICE FOR SUPPLYING POLYPHASE IMAGE SIGNAL TO LIQUID CRYSTAL DISPLAY APPARATUS

(75) Inventors: Ichiro Negishi, Yokosuka; Yuji Uchiyama, Chigasaki, both of (JP)

(73) Assignee: Victor Company of Japan, Ltd., Yokohama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,524

(22) Filed: Jun. 17, 1998

(30) Foreign Application Priority Data

Jun. 17, 1997 (JP) ..... 9-176357

(51) Int. Cl.[7] ..... G09G 3/36

(52) U.S. Cl. ..... 345/87; 345/92; 345/94; 345/98; 345/100; 345/103

(58) Field of Search ..... 345/98, 92, 94, 345/103, 100, 196, 513, 87

(56) References Cited

U.S. PATENT DOCUMENTS 5,530,457 * 6/1996 Helgeson ..... 345/185
5,543,824 * 8/1996 Priem et al. ..... 345/201
5,764,212 * 6/1998 Nishitani et al. ..... 345/98
5,900,856 * 5/1999 Iino et al. ..... 345/100

FOREIGN PATENT DOCUMENTS 06342272A 12/1994 (JP) .
09127919A 5/1997 (JP) .

* cited by examiner

*Primary Examiner*—Richard Hjerpe
*Assistant Examiner*—Jean Lesperance
(74) *Attorney, Agent, or Firm*—Jacobson Holman, PLLC

(57) ABSTRACT

A polyphase image signal generating device has a latch selection to latch original polyphase image signals of a first to an N-th phase original image signal (N being a natural number of two or more), and a selector connected to the latch section. The selector selects the original polyphase image signals in a first order from the first to the N-th phase original image signal or a second order from the N-th phase to the first original image signal, to output the selected polyphase image signals. The latch section may include N latches of a first to an N-th latch where an L-th original image signal and a {N-(L-1)}-th original image signal are latched by both an L-th and a {N-(L-1)}-th latch, L being a natural number of N or less. The selector selects the L-th original image signal in response to a control signal indicating the first order, whereas the {N-(L-1)}-th original image signal in response to another control signal indicating the second order.

9 Claims, 5 Drawing Sheets

DEVICE FOR SUPPLYING POLYPHASE IMAGE SIGNAL TO LIQUID CRYSTAL DISPLAY APPARATUS

BACKGROUND OF THE INVENTION

The present invention relates to a device for supplying polyphase image signals to a liquid crystal displaying apparatus.

Image signals to be displayed are converted into polyphase signals of N-phases (N being a natural number of 2 or more) and supplied to a liquid crystal displaying apparatus. An image signal of each phase has an occupied bandwidth corresponding to 1/N of that of the original image signals.

The polyphase signals are supplied to an active-matrix liquid crystal displaying apparatus with switching transistors, such as, thin film transistors (TFT) and MOS transistors, provided on intersections of signal electrodes (lines) and scanning electrodes.

The switching transistors switch a voltage supplied to each pixel to separate two-dimensionally arranged pixels for non-crosstalk driving if memory devices for holding voltages corresponding to image signal per pixel reveal low frequency characteristics or the switching transistors reveal low switching response.

When projecting an image onto a screen by a projection-type displaying apparatus, the displaying apparatus may be set on the screen's front or back side. The image is reversed in a horizontal direction of the screen when projected on the back side, for example.

An image projected onto a screen by an active-matrix liquid crystal displaying apparatus supplied with single phase image signals can be reversed by switching a shifting direction of a horizontal shift register of a horizontal driver of the displaying apparatus.

On the other hand, if the active-matrix liquid crystal displaying apparatus is supplied with polyphase image signals, such shifting direction switching reverses an order of arrangement of pixels group, the number of pixels in each group corresponding to the number of phases of the image signals, however, not an order of arrangement of pixels in each group. A normal image thus cannot be displayed on the screen.

A device for supplying polyphase image signals to the active-matrix liquid crystal displaying apparatus thus requires reversing the order of arrangement of pixels in each group for applicability in image projection on the screen from both the front and back sides.

However, such a device is fabricated into a one chip IC with a lot of data input/output terminals and signal switching circuitry, that is, a costly large scale one chip IC.

On the other hand, such a device with a plurality of ICs requires data communications among the ICs for image switching in a horizontal direction of a screen. Many costly data input/output terminals are thus required per IC.

SUMMARY OF THE INVENTION

A purpose of the present invention provides a device for generating polyphase image signals capable of reversing the order of the image signals with less circuitry and data input/output terminals.

Another purpose of the present invention is to provide an image displaying apparatus with a liquid crystal display and such a device for supplying polyphase image signals to the liquid crystal display.

The present invention provides a device for generating polyphase image signals comprising: latch means for latching original polyphase image signals of a first to an N-th phase original image signal, N being a natural number of two or more; and a selector connected to the latch, to select the original polyphase image signals in a first order from the first to the N-th phase original image signal or a second order from the N-th phase to the first original image signal, to output the selected polyphase image signals.

The present invention further provides an image displaying apparatus comprising: a liquid crystal display with pixel electrodes arranged in a matrix, the pixel electrodes being divided into M groups of a first to an M group in a horizontal direction of the matrix, each group having N pixel electrodes, M being a natural number of one or more, N being a natural number of two or more; a generator to generate polyphase image signals to be displayed, the polyphase image signals having a first to an N-th phase image signal; a driver to drive the liquid crystal display in response to the polyphase image signals, the polyphase image signals being selectively supplied to the liquid crystal display in a first order from the first to the N-th phase image signal, the N pixel electrodes in each group being activated in order from the first to the M-th group or in a second order of from the N-th to the first phase image signal, the pixel electrodes in each group being activated in order from the M-th to the first group.

DETAILED DESCRIPTION OF THE PREFERRED EMBODIMENT

Preferred embodiments according to the present invention will be described with respect to the attached drawings.

Figure 1:
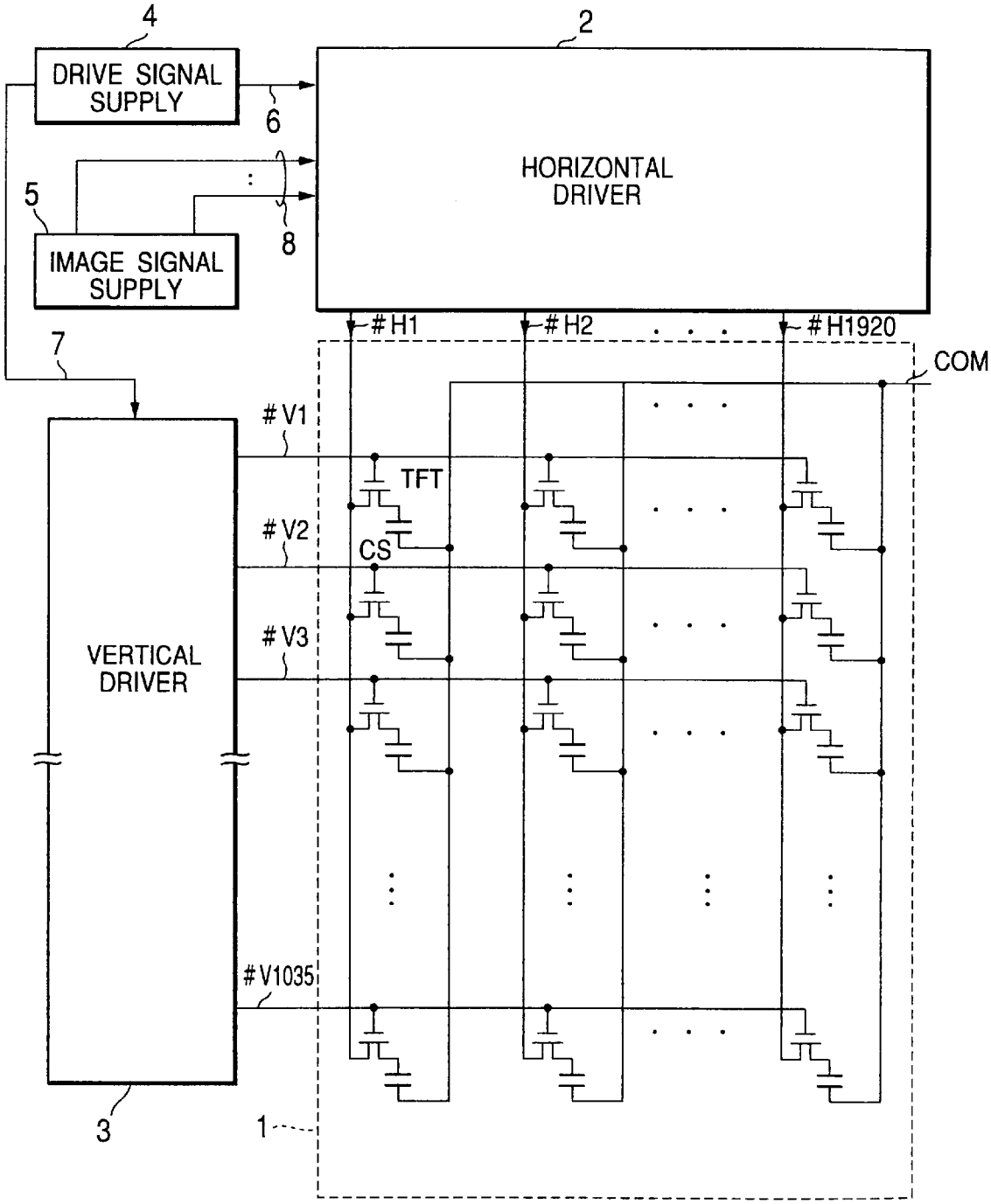
FIG. 1 is a block diagram of an active-matrix liquid crystal displaying apparatus and a drive circuitry.

In FIG. 1, an active-matrix liquid crystal displaying apparatus (called active-matrix LCD herein after) 1 has a liquid crystal sealed between a pair of substrates. On one of the substrates, a common electrode COM is provided, whereas provided on the other substrate are pixel electrodes corresponding to two-dimensionally arranged pixels, memory elements (capacitor) CS connected to the pixel electrodes, signal lines #H1, #H2, . . . , #H1920(1920=N), address lines #V1, #V2, . . . , # V1035(1035=Q) and thin film transistors TFT provided per pixel.

A horizontal driver 2 supplies image signals to the memory elements CS through the signal lines #H1, #H2, . . . , and #H1920. A vertical driver 3 selects the memory elements CS through the address lines #V1, #V2, . . . , #V1035.

To the horizontal driver 2, a drive signal supply 4 supplies, through a transmission line 6, a start pulse H-ST, two-phase clock pulses H-C1 and H-C2 and a shifting direction control signal R/L-CTL. Further, to the horizontal driver 2, an image signal supply 5 supplies N-phase image signals to be displayed through a transmission line 8. The phase N is eight in the embodiment.

The drive signal supply 4 also supplies a start pulse V-ST and two-phase clock pulses V-C1 and V-C2 to the vertical driver 3 through a transmission line 7.

The horizontal driver 2 will be described in detail with reference to FIG. 2.

Figure 2:
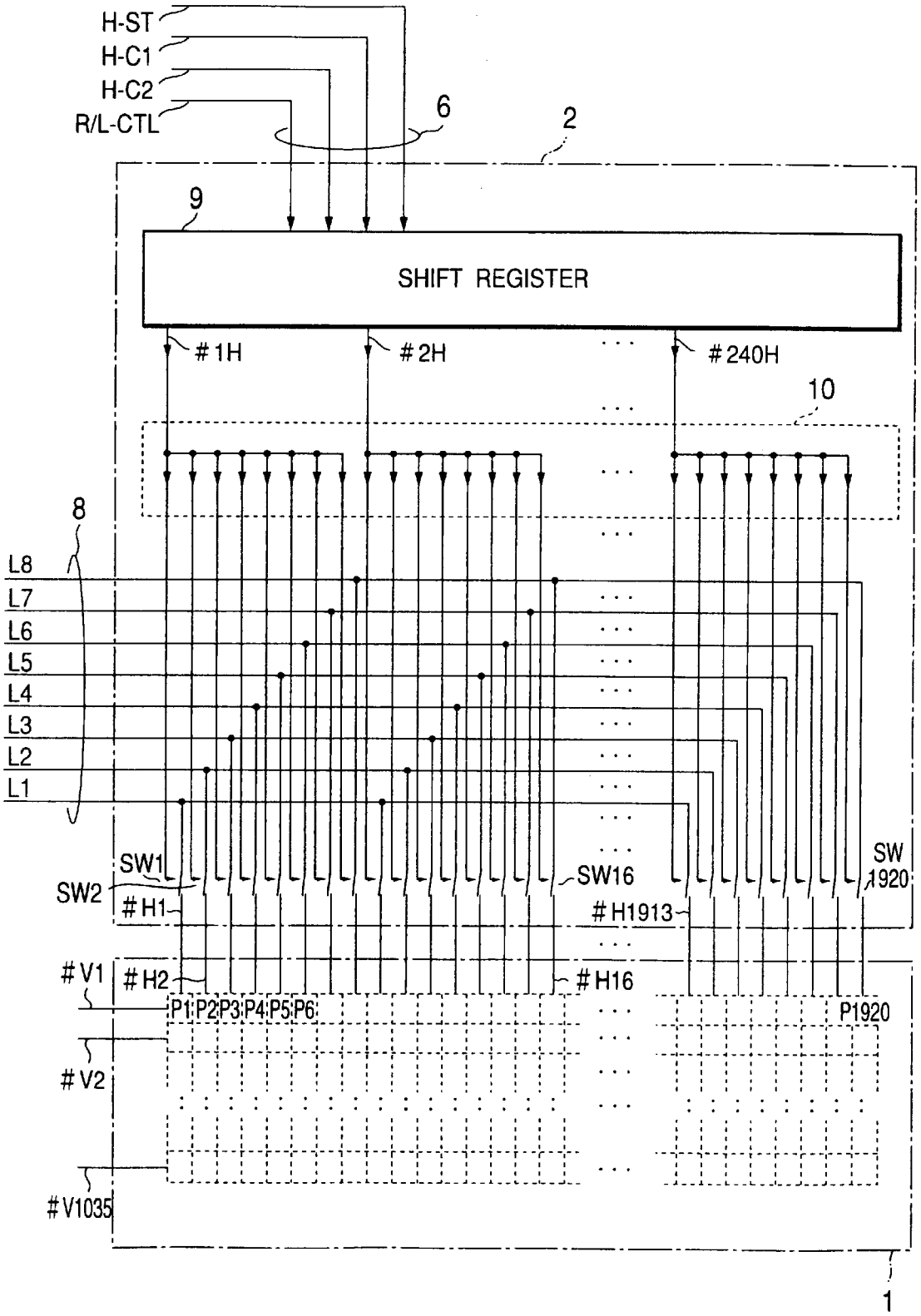
FIG. 2 is a partial block diagram of the active-matrix liquid crystal displaying apparatus and the drive circuitry shown in FIG. 1.

In FIG. 2, pixels P1, P2, . . . , and P1920 are aligned on the first line in the active-matrix LCD 1. Signal lines #H1, #H16, . . . , and #1913, . . . correspond to the N number of the signal lines #H1, #H2, . . . , and #H1920, respectively, in FIG. 1.

Supplying single-phase image signals to the pixels P1, P2, . . . , and P1920 through the signal lines #H1, #H2, . . . , and #H1920 is conducted by a shift register 9. In detail, the shift register 9 sequentially selects the signal lines #H1, #H2, . . . , and #H1920 one by one to sequentially supply the image signals to the pixels P1, P2, . . . , and P1920 one by one.

Polyphase image signals are, on the other hand, supplied to the pixels P1, P2, . . . , and P1920 with simultaneous selection of a group of N pixels corresponding to the number N of phases of the polyphase image signals.

Supplying the polyphase image signals is described in detail.

The number of pixels selected simultaneously is P/N where P is the number of the pixels P1, P2, . . . aligned on one line and N is the number of phases of image signals.

In the embodiment, image signals are divided into eight phases (N=8) and the number P of pixels aligned on one line is 1920. The 1920 pixels are thus divided into 240 (1920/8) groups of pixels each including 8 pixels. Output lines #1H, #2H, . . . , and #240H connected between the shift register 9 and a level shifter 10 of FIG. 2 are 240 signal lines (electrodes) corresponding to the 240 groups of pixels. The number of pixels arranged in a vertical direction in the active-matrix LCD 1 is Q (=1035) in FIG. 2.

The shift register 9 supplies switching control signals to switch SW1 to SW1920 through the output lines #1H, #2H, . . . , and #240H. The switches simultaneously select 8 pixels of one pixel group.

Image signals #10, #20, . . . , and #80 are transferred from the image signal supply 5 of FIG. 1 to the horizontal driver 2 through transmission lines L1, L2, . . . , and L8, respectively, in the case where the active-matrix LCD 1 is set in front of a screen (not shown).

On the other hand, in the case where the active-matrix LCD 1 is set in the back of the screen, image signals (#80), (#70), . . . , and (#10) are transferred from the image signal supply 5 to the horizontal driver 2 through the transmission lines L1, L2, . . . , and L8, respectively.

The first phase-image signal #10 of the eight-phase image signals is supplied to the signal line #H1 via switch SW1 when turned on by a switching control signal supplied on the output line #1H, and further supplied to the signal line #H9 via switch SW9 when turned on by a switching control signal supplied on the output line #2H, and so on. In other words, the first phase-image signal #10 is supplied to a signal line #H[1+(K−1)N] via switch when turned on by a switching control signal supplied on an output line #KH where K is 1, 2, . . . , 240.

Likewise the second phase-image signal #20 of the eight phase image signals is supplied to the signal line #H2 via switch SW2 when turned on by the switching control signal supplied on the output line #1H, and further supplied to the signal line #H10 via switch SW10 when turned on by the switching control signal supplied on the output line #2H, and so on. In other words, the second phase-image signal #20 is supplied to a signal line #H[2+(K−1)N] via switch when turned on by a switching control signal supplied on an output line #KH.

Further, the third phase-image signal #30 of the eight-phase image signals is supplied to the signal line #H3 via switch SW3 when turned on by the switching control signal supplied on the output line #1H, and further supplied to the signal line #H11 via switch SW11 when turned on by the switching control signal supplied on the output line #2H, and so on. In other words, the third phase-image signal #30 is supplied to a signal line #H[3+(K−1)N] via switch when turned on by a switching control signal supplied on an output line #KH.

In the same way, the eighth phase-image signal #80 of the eight phase image signals is supplied to the signal line #H8 via switch SW8 when turned on by the switching control signal supplied on the output line #1H, and further supplied to the signal line #H16 via switch SW16 when turned on by the switching control signal supplied on the output line #2H, and so on. In other words, the eighth phase-image signal #80 is supplied to a signal line #H[8+(K−1)N] via switch when turned on by a switching control signal supplied on an output line #KH.

The same is true for the image signals (#80), (#70), . . . , and (#10) in the case where the active-matrix LCD 1 is set in the back of the screen and hence the description of the switching operation for those image signals is omitted. Further, in FIG. 2, the signs "SW3", "SW8", "SW11", "#H3", "#H8", "#H10" and "#H11" are omitted for brevity.

As described above, it is understood that N-phase image signals supplied from the signal supply 5 to the horizontal driver 2 are supplied to signal lines #H[i+(K−1)N] via switches when turned on by switching control signals supplied on output lines #KH where i is 1, 2, . . . , and 8 and K is 1, 2, . . . , and 240.

As already described, the drive signal supply 4 supplies the start pulse V-ST and two-phase clock pulses V-C1 and V-C2 to the vertical driver 3 through the transmission line 7. These signals activate a vertical shift register (not shown) of the vertical driver 3 to supply output signals to scanning electrodes #V1, #V2, . . . , and #V1035.

Vertical scanning is made by the scanning electrodes #V1, #V2, . . . , and #V1035 while pixels of one group, the number of the pixels corresponding to the number of phase of the polyphase image signals, are simultaneously selected in a horizontal direction to display an image.

A first embodiment of the image signal supply 5 of FIG. 1 will be described in detail with reference to FIG. 3.

Figure 3:
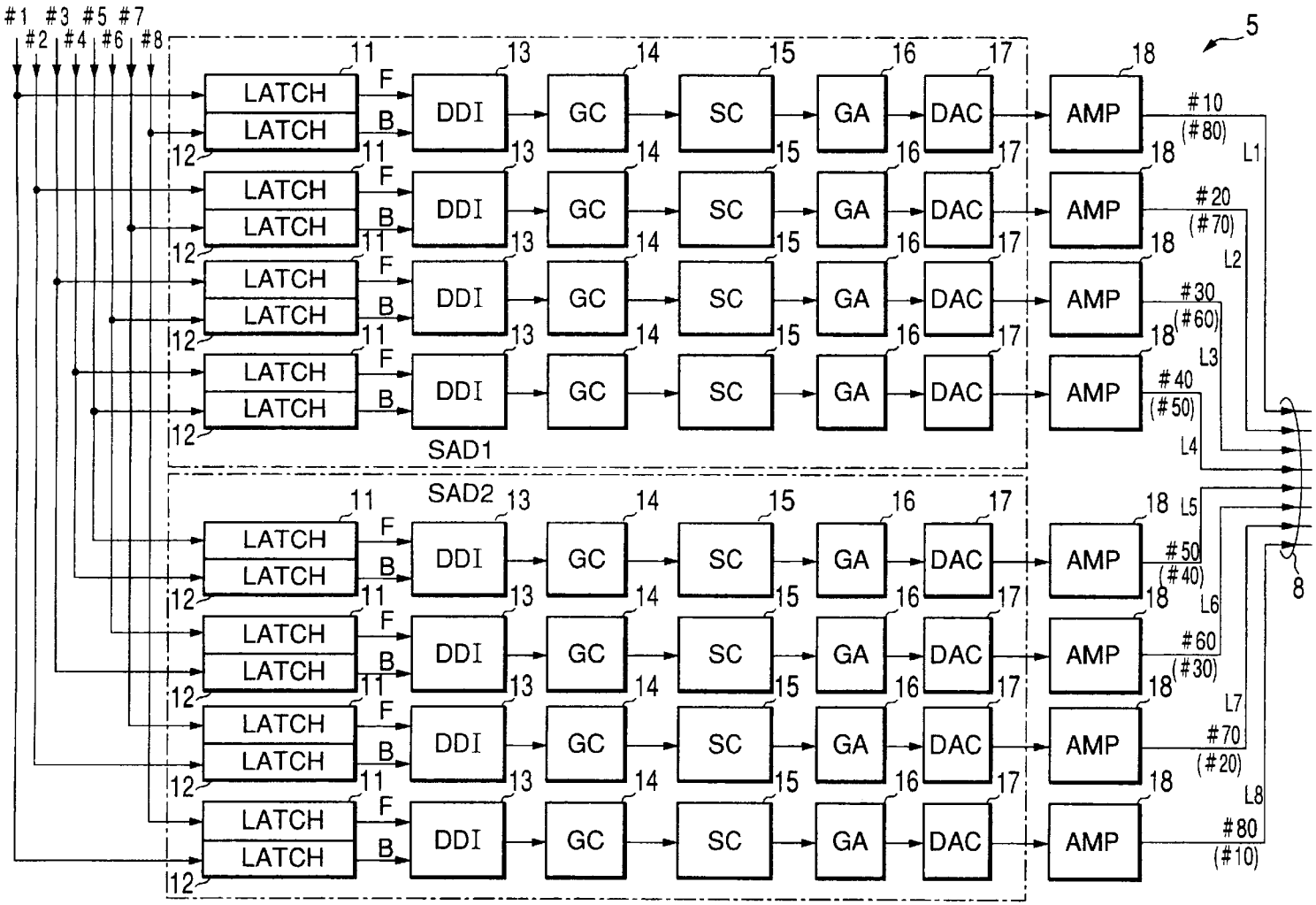
FIG. 3 is a block diagram of a first embodiment of a polyphase image signal supply according to the present invention.

The image signal supply 5 shown in FIG. 3 is provided with two (M=2) signal processors SAD1 and SAD2. Each processor includes four circuit groups. Totally eight circuit groups are provided for generating the eight (N=8) phase-image signals.

Each circuit group includes two input data latches 11 and 12, a display direction inverter (DDI) 13 as a selector for selecting either data latched by the input data latches 11 and 12, a gamma corrector (GC) 14, a shading corrector (SC) 15, a gain adjuster (GA) 16 and a digital-to-analog 10 (DAC) converter 17.

The four circuit groups in each of the signal processors SAD1 and SAD2 are called the first to fourth signal processing circuits from the top to bottom in FIG. 3.

Original eight phase-image signals #1 to #8 are supplied to the four circuit groups. In this embodiment, the eight phase-image signals are High-Vision digital image data of a predetermined number of bits supplied from a known apparatus, such as, a High-Vision video camera.

Accordingly, in FIG. 2, the number of the pixels P1, P2, . . . , and P1920 aligned on one line corresponds to the number of the effective pixels (1920) per scanning line of High-Vision standard. Further, the number Q of pixels arranged in the vertical direction corresponds to the number of the effective scanning lines (1035) per frame.

More in detail, supplied to the latches 11 and 12 of the first signal processing circuit of the signal processor SAD1 are the first and the eighth phase-image signals #1 and #8, respectively, of the eight-phase image signals.

On the other hand, supplied to the latches 11 and 12 of the first signal processing circuit of the signal processor SAD2 are the fifth and the fourth phase-image signals #5 and #4, respectively, of the eight-phase image signals.

Next, supplied to the latches 11 and 12 of the second signal processing circuit of the signal processor SAD1 are the second and the seventh phase-image signals #2 and #7, respectively, of the eight-phase image signals.

On the other hand, supplied to the latches 11 and 12 of the second signal processing circuit of the signal processor SAD2 are the sixth and the third phase-image signals #6 and #3, respectively, of the eight-phase image signals.

Further, supplied to the latches 11 and 12 of the third signal processing circuit of the signal processor SAD1 are the third and the sixth phase-image signals #3 and #6, respectively, of the eight-phase image signals.

On the other hand, supplied to the latches 11 and 12 of the third signal processing circuit of the signal processor SAD2 are the seventh and the second phase-image signals #7 and #2, respectively, of the eight-phase image signals.

Furthermore, supplied to the latches 11 and 12 of the fourth signal processing circuit of the signal processor SAD1 are the fourth and the fifth phase-image signals #4 and #5, respectively, of the eight-phase image signals.

On the other hand, supplied to the latches 11 and 12 of the fourth signal processing circuit of the signal processor SAD2 are the eighth and the first phase-image signals #8 and #1, respectively, of the eight-phase image signals.

In other words, an L-th original image signal and a {N−(L−1)}-th image signal of an N-phase image signals are latched by both an L-th and a {N−(L−1)}-th latch, L being a natural number of N or less.

In FIG. 3, a symbol "F" shown between each data latch 11 and display direction inverter 13 denotes that the output data of the data latch 11 is selected by the display direction inverter 13 in response to a switching control signal supplied from a controller (not shown) when the active-matrix LCD 1 is set in front of the screen. On the other hand, a symbol "B" shown between each data latch 12 and display direction inverter 13 denotes that the output data of the data latch 12 is selected by the display direction inverter 13 in response to another switching control signal from the controller when the active-matrix LCD 1 is set at the back of the screen.

In case of "F", the output data of each data latch 11 is selected by the corresponding display direction inverter 13 and supplied to the following gamma corrector 14 where the degree of contrast of images carried by the output data is corrected. The output data is then supplied to the shading corrector 15 where variation in brightness of the images carried by the output data is corrected. And, the gain of the output data is adjusted by the gain adjuster 16. The output data are then converted into analog image signals by the DA converter 17. The analog signals are supplied to corresponding amplifiers (AMP) 18 that output image signals of phases #10, #20, . . . , and #80.

On the other hand, in case of "B", the output data of each data latch 12 is selected by the corresponding display direction inverter 13 and supplied to the following gamma corrector 14, then to the shading corrector 15 and the gain adjuster 16 where the output data are subjected to the same image signal processing as described above. The output data are converted into analog image signals by the DA converter 17. The analog signals are supplied to the corresponding amplifiers 18 that output image signals of phases (#80), (#70), . . . , and (#10).

The image signals of phases #10, #20, . . . , and #80 are transmitted through the transmission lines L1, L2, L8, respectively, to the horizontal driver 2. The same is true for the image signals of phases (#80), (#70), and (#10).

When the active-matrix LCD 1 is set in front of the screen, the shift register 9 conducts a shifting operation in a normal direction by the shifting direction control signal R/L-CTL supplied from the drive signal supply 4 through the transmission line 6 to produce the output on the output lines in the order of #1H→#2H→ . . . →#240H.

As described above, since the image signals of phases #10, #20, . . . , and #80 are transmitted through the transmission lines L1, L2, . . . , L8, respectively, to the horizontal driver 2, the active-matrix LCD 1 set in front of the screen can display a normal image thereon.

On the other hand, when the LCD 1 is set at the back of the screen, the shift register 9 conducts a shifting operation in the reverse direction by the shifting direction control signal R/L-CTL to produce the output on the output lines in the order of #240H→ . . . #2H→#1H.

As described above, since the image signals of phases (#80), (#70), . . . , and (#10) are transmitted through the transmission lines L1, L2, . . . , L8, respectively, to the horizontal driver 2, the active-matrix LCD 1 set in at the back of the screen can also display a normal image thereon.

In this embodiment, polyphase-image signals of High-Vision digital image data are supplied to the image signal supply of the present invention. However, not only this, for example, NTSC analog polyphase-image signals can be supplied to the image signal supply with analog-to-digital conversion.

Next, a second embodiment of the image signal supply 5 of FIG. 1 will be described in detail with reference to FIG. 4.

Figure 4:
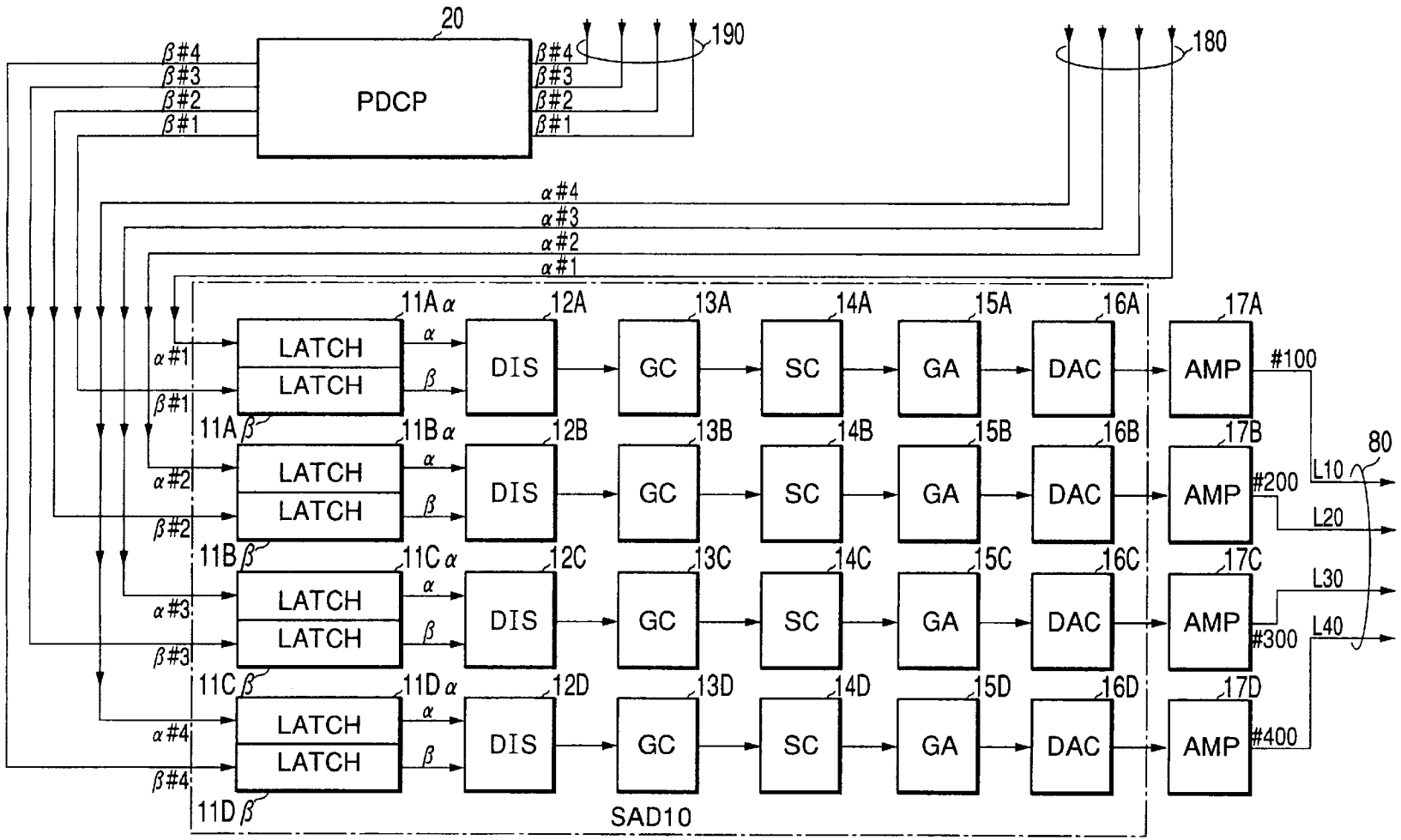
FIG. 4 is a block diagram of a second embodiment of a polyphase image signal supply according to the present invention.

The image signal supply shown in FIG. 4 is provided with a signal processor SAD10 that includes four circuit groups for generating four (N=4) phase-image signals.

The circuit group that is supplied polyphase image signals α#1 and β#1 includes two input data latches 11Aα and 11Aβ, a displayed image selector (DIS) 12A for selecting either data latched by the input data latches 11Aα and 11Aβ, a gamma corrector (GC) 13A, a shading corrector (SC) 14A, a gain adjuster (GA) 15A and a digital-to-analog converter (DAC) 16A. The other three circuit groups supplied polyphase image signals α#2 and β#2, α#3 and β#3, and α#4 and β#4 also include the same circuits connected in series.

The polyphase image signalsα#1, α#2, α#3 and α#4 are the first- to the fourth-phase image signal, respectively, supplied from a known apparatus (not shown) through transmission lines 180.

The other polyphase image signals β#1, β#2, β#3 and β#4 are also the first- to the fourth-phase image signal, respectively, supplied from a known apparatus (not shown) through transmission lines 190, however, applied pixel density conversion processing by a pixel density conversion processor (PDCP) 20.

In detail, the pixel density conversion processor 20 converts the first- to fourth-phase image signals β#1, β#2, β#3 and β#4 into polyphase image signals that match transversal and longitudinal pixel numbers, or an aspect ratio of an active-matrix liquid crystal of a displaying apparatus. The PDCP 20 is controlled by a clock signal the same as or synchronized with a clock signal used for the signal processor SAD10. Further, the PDCP 20 can be configured so that it applies the pixel density conversion processing to any one of or all the first- to fourth-phase image signals β#1, β#2, β#3 and β#4.

The first-phase image signal α#1 and the other first-phase image signal β#1 that has been applied the pixel density conversion processing by the PDCP 20 are supplied to the input data latches 11Aα and 11Aβ, respectively.

Either of the first-phase image signals α#1 and β#1 are selected by the displayed image selector 12A that is controlled by a selection control signal input from terminal equipment via a mouse, a keyboard, etc., to match an image to be displayed. A symbol "α" ("β") shown in, for example, between the data latches 11Aα and 11Aβ and the displayed image selector 12A denotes that the first-phase image signals α#1 (β#1) is selected.

The selected first-phase image signal α#1 or β#1 is supplied to the succeeding gamma corrector 13A, shading corrector 14A, gain adjuster 15A and digital-to-analog converter 16A and subjected to the same signal processing as those by the circuits 14 to 17 shown in FIG. 3.

The other second- to fourth-phase image signals α#2 and β#2, α#3 and β#3, and α#4 and β#4 are also subjected to the same signal processing as those for the first-phase image signals α#1 and β#1.

The output signals of the DA converters 16A to 16D are supplied to amplifiers 17A to 17D, respectively, that output the first- to fourth-phase image signals #100 to #400. The output signals #100 to #400 are transmitted through transmission lines L10 to L40, respectively, to an active-matrix liquid crystal displaying apparatus. The active-matrix liquid crystal displaying apparatus for the second embodiment is basically the same as that shown in FIG. 2 and hence its description is omitted here due to the fact that the difference is only the number of phases of the input polyphase signals.

Next, a third embodiment of the image signal supply 5 of FIG. 1 will be described in detail with reference to FIG. 5.

Figure 5:
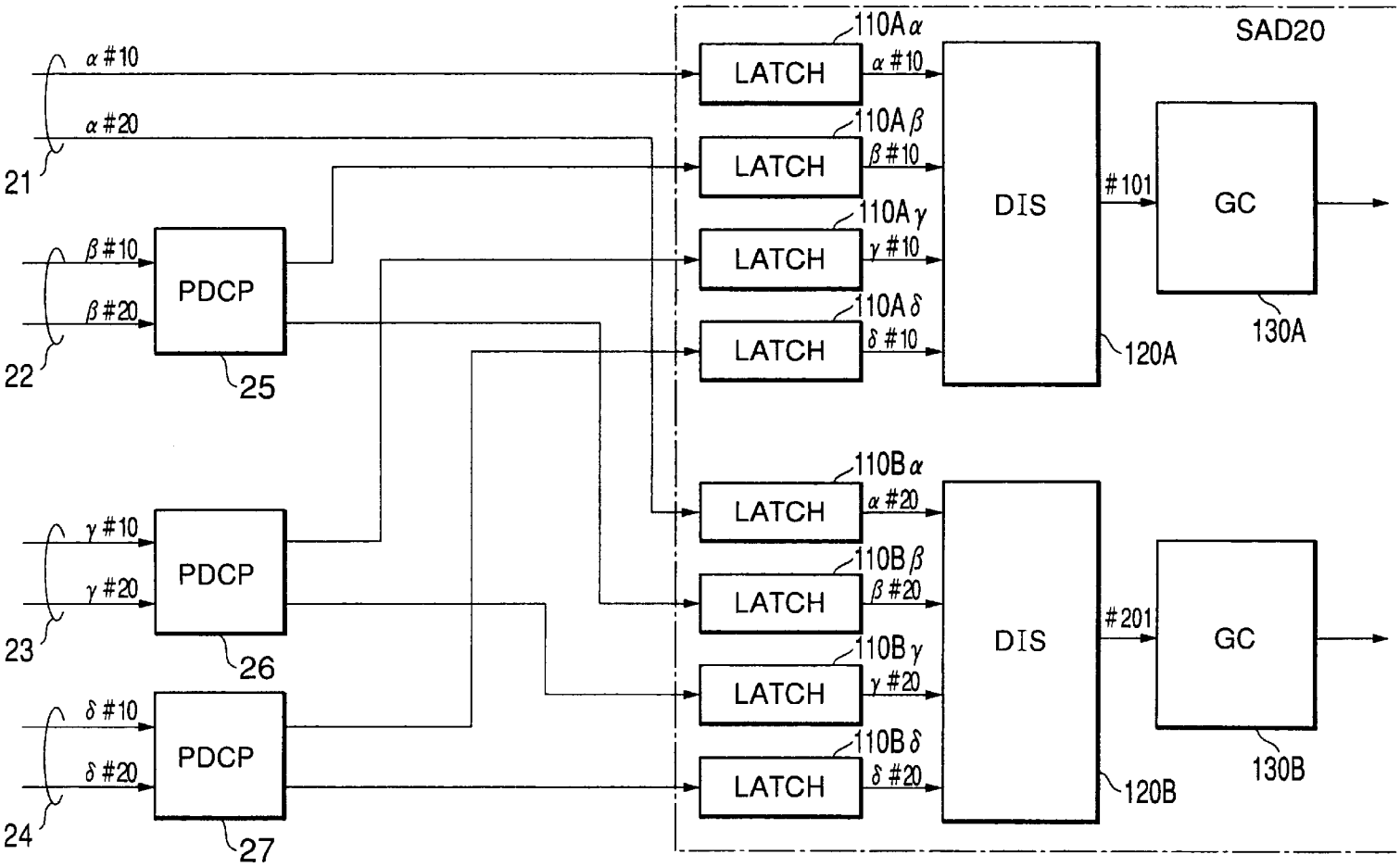
FIG. 5 is a block diagram of a third embodiment of a polyphase image signal supply according to the present invention.

The image signal supply shown in FIG. 5 is provided with a signal processor SAD20 that includes two circuit groups for generating two (N=2) phase-image signals.

The first circuit group includes four input data latches 110Aα, 110Aβ, 110Aγ and 110Aδ, a displayed image selector (DIS) 120A, and a gamma corrector (GC) 130A. The second circuit group includes four input data latches 110Bα, 110Bβ, 110Bγ and 110Bδ, a displayed image selector (DIS) 120B, and a gamma corrector (GC) 130B. The first and second circuit groups also include succeeding shading corrector, gain adjuster and digital-to-analog converter that are the same as those shown in FIG. 4 and hence omitted here for brevity.

The first- and the second-phase image signal α#10 and α#20 are supplied from a known apparatus (not shown) to the input data latches 110Aα and 110Bα, respectively, through transmission lines 21.

The first- and the second-phase image signal β#10 and β#20 are supplied from a known apparatus (not shown) to the input data latches 110Aβ and 110Bβ through transmission lines 22, however, applied pixel density conversion processing by a pixel density conversion processor (PDCP) 25.

The first- and the second-phase image signal γ#10 and γ#20 are supplied from a known apparatus (not shown) to the input data latches 110Aγ and 110Bγ through transmission lines 23, also applied pixel density conversion processing by a pixel density conversion processor (PDCP) 26.

The first- and the second-phase image signal δ#10 and δ#20 are supplied from a known apparatus (not shown) to the input data latches 110Aδ and 110Bδ through transmission lines 24, also applied pixel density conversion processing by a pixel density conversion processor (PDCP) 27.

The pixel density conversion processor 25 to 27 are the same as the PDCP 20 shown in FIG. 4. Further, the apparatuses supplying polyphase image signals through the transmission lines 180 and 190 in FIG. 4, and 21 to 24 in FIG. 5 may be different polyphase image signal sources from each other.

In FIG. 5, either one of the first-phase image signals α#10, β#10, γ#10 and δ#10 supplied to and latched by the input data latches 110Aα, 110Aβ, 110Aγ and 110Aδ, respectively, are selected by the displayed image selector 120A and supplied as the first-phase image signal #101 to the gamma corrector 130A, and further to the succeeding circuits (not shown).

Further, either one of the second-phase image signals α#20, β#20, γ#20 and δ#20 supplied to and latched by the input data latches 110Bα, 110Bβ, 110Bγ and 110Bδ, respectively, are selected by the displayed image selector 120B and supplied as the second-phase image signal #201 to the gamma corrector 130B, and further to the succeeding circuits (not shown).

The output signals of the signal processor SAD20 are supplied to amplifiers and transmitted through transmission lines to an active-matrix liquid crystal displaying apparatus. The amplifiers and the transmission lines are the same as those shown in FIG. 4 and hence not shown here for brevity. The active-matrix liquid crystal displaying apparatus for the third embodiment is also basically the same as that shown in FIG. 2 and hence its description is omitted here due to the fact that the difference is only the number of phases of the input polyphase signals.

As described above, the present invention provides a device that generates polyphase image signals. The device is provided with a latch selection to latch original polyphase image signals of a first to an N-th phase original image signal (N being a natural number of two or more), and a selector connected to the latch section.

The selector selects the original polyphase image signals in a first order from the first to the N-th phase original image signal or a second order from the N-th phase to the first original image signal, to output the selected polyphase image signals.

The latch section may include N latches of a first to an N-th latch where an L-th original image signal and a {N−(L−1)}-th original image signal are latched by both an L-th and a {N−(L−1)}-th latch, L being a natural number of N or less. In this case, the selector selects the L-th original image signal in response to a control signal indicating the first order, whereas selecting the {N−(L−1)}-th original image signal in response to another control signal indicating the second order.

The selected polyphase image signals may be supplied to a liquid crystal display with pixel electrodes arranged in a matrix where the pixel electrodes are divided into M groups of a first to an M group in a horizontal direction of the matrix, each group having N pixel electrodes, M being a natural number of one or more.

The present invention, therefore, achieves a device for generating polyphase image signals capable of reversing the order of the image signals with less circuitry and data input/output terminals. Because there is no need to have data communications among the N latches and also among other later stage circuitry.

Further, the present invention achieves a compact polyphase image signal generating device. Because the less the number of phases of polyphase image signal, the less the number of latches and other later stage circuitry.

What is claimed is:

1. A device for generating polyphase image signals to be projected onto a screen via a projection-type displaying apparatus that is set either in front of or behind the screen, comprising:

latch means having input and output stages for latching original polyphase image signals of a first to an N-th phase original image signal, an image signal of each phase having a bandwith corresponding to 1/N of a bandwith of input original image signals for allocating low frequency, N being a natural number of two or more, said latch means including a first to an N-th latch section, each latch section having a first and a second latch, the first to N-th phase original image signals being input to and latched by the first latches of the first to N-th latch sections in a first order from the first to the N-th phase original image signals, the first to N-th phase original image signals also being input to and latched by the second latches of said first to N-th latch sections in a second order from the N-th to the first phase original image signals; and a selector connected to said latch means at the output stage thereof, to select outputs of the first latches in the first order when the displaying apparatus is set in front of the screen or outputs of the second latches in the second order when the displaying apparatus is set behind the screen, the selected polyphase image signals being supplied to the displaying apparatus.

2. The apparatus according to claim 1 further comprising means for converting at least one of the original polyphase image signals into another image signal that matches an aspect ratio of a displaying apparatus on which the selected polyphase image signals are to be displayed.

3. A projection-type image displaying apparatus for projecting an image onto a screen, the displaying apparatus being set either in front of or behind the screen, comprising:

a liquid crystal display with pixel electrodes arranged in a matrix, the pixel electrodes being divided into M groups of a first to an M group in a horizontal direction of the matrix, each group having N pixel electrodes, M being a natural number of one or more, N being a natural number of two or more;

a generator to generate polyphase image signals to be displayed, the polyphase image signals having a first to an N-th phase image signal, an image signal of each phase having a bandwith corresponding to 1/N of a bandwith of input original image signals for allocating low frequency, the generator including a first to an N-th latch section, each latch section having a first and a second latch, the first to N-th phase original image signals being input to and latched by the first latches of said first to N-th latch sections in a first order from the first to the N-th phase original image signals, the first to N-th phase original image signals also being input to and latched by the second latches of said first to N-th latch sections in a second order from the N-th to the first phase original image signals;

a driver to drive the liquid crystal display in response to the polyphase image signals, outputs of the first latches being supplied to the liquid crystal display in the first order, the N pixel electrodes in each group being activated in order from the first to the M-th group when the displaying apparatus is set in front of the screen or outputs of the second latches being supplied to the liquid crystal display in the second order, the pixel electrodes in each group being activated in order from the M-th to the first group when the displaying apparatus is set behind the screen.

4. The apparatus according to claim 3 further comprising means for converting at least one of the polyphase image signals into another image signal that matches the number of the pixel electrodes of the liquid crystal display arranged in the matrix.

5. The projection-type image displaying apparatus according to claim 3, further comprising a gamma corrector, provided after said first to said N-th latch section, for applying gamma correction to the latched polyphase signals.

6. The projection-type image displaying apparatus according to claim 3, further comprising a shading corrector, provided after said first to said N-th latch section, for applying shading correction to the latched polyphase signals.

7. A projection-type image displaying apparatus for projecting an image onto a screen, the displaying apparatus being set either in front of or behind the screen, comprising:

latch means having input and output stages for latching original polyphase image signals of a first to an N-th phase original image signal, an image signal of each phase having a bandwidth corresponding to 1/N of a bandwidth of input original image signals for allocating low frequency, N being a natural number of two or more, said latch means including a first to an N-th latch section, each latch section having a first and a second latch, the first to N-th phase original image signals being input to and latched by the first latches of said first Lo N-th latch sections in a first order from the first to the N-th phase original image signals, the first to N-th phase original image signals also being input to and latched by the second latches of said first to N-th latch sections in a second order from the N-th to the first phase original image signals;

a selector connected to said latch means at the output stage thereof, to select outputs of the first latches in the first order or outputs of the second latches in the second order; and a display to receive the polyphase image signals selected in the first or the second order and project the selected signals onto the screen, wherein the original polyphase image signals are selected in the first order when the display is set in front of the screen or in the second order when the display is set behind the screen.

8. The projection-type image displaying apparatus according to claim 7, further comprising a gamma corrector, provided after the selector, for applying gamma correction to the selected polyphase signals.

9. The projection-type image displaying apparatus according to claim 7, further comprising a shading corrector, provided after the selector, for applying shading correction to the selected polyphase signals.

* * * * *